US009299233B2

(12) United States Patent
Yoon

(10) Patent No.: US 9,299,233 B2
(45) Date of Patent: Mar. 29, 2016

(54) ANTI-CRIME SYSTEM USING RF DONGLE

(71) Applicant: SUNG GWANG CO., LTD., Daejeon (KR)

(72) Inventor: Jun Ho Yoon, Daejeon (KR)

(73) Assignee: SUNG GWANG CO., LTD., Daejeon (KR)

( * ) Notice: Subject to any disclaimer, the term of this patent is extended or adjusted under 35 U.S.C. 154(b) by 0 days.

(21) Appl. No.: 14/402,985

(22) PCT Filed: Jun. 5, 2013

(86) PCT No.: PCT/KR2013/004957
§ 371 (c)(1),
(2) Date: Nov. 21, 2014

(87) PCT Pub. No.: WO2013/183935
PCT Pub. Date: Dec. 12, 2013

(65) Prior Publication Data

US 2015/0137974 A1 May 21, 2015

(30) Foreign Application Priority Data

Jun. 8, 2012 (KR) ..... 10-2012-0061499

(51) Int. Cl.
*G08B 13/14* (2006.01)
*G08B 13/24* (2006.01)
*G08B 25/10* (2006.01)
(Continued)

(52) U.S. Cl.
CPC ..... *G08B 13/2402* (2013.01); *G08B 13/08* (2013.01); *G08B 25/009* (2013.01); *G08B 25/10* (2013.01)

(58) Field of Classification Search
CPC ..... G08B 13/2402; G08B 13/2491; G08B 13/08; G08B 13/00; G08B 13/04; G08B 13/12; G08B 13/19684; G08B 13/19678; G08B 21/18; G08B 25/09; G08B 25/10; G08B 25/14; G08B 29/02; G08B 27/00; E05Y 2400/44; E05Y 2201/422; E05Y 2800/40
USPC ..... 340/572.1, 540, 545.1, 545.7, 545.9, 340/541, 568.1, 571, 286.01, 286.02, 340/539.1; 455/41.1, 66.1, 554.1, 41.2
See application file for complete search history.

(56) References Cited

U.S. PATENT DOCUMENTS 8,427,314 B2 * 4/2013 Billiard ..... G08B 7/06 340/568.1
8,508,345 B2 * 8/2013 Mornhineway ..... G08C 17/02 340/12.22
2008/0266089 A1 * 10/2008 Haren ..... G06F 21/88 340/568.1

(Continued)

FOREIGN PATENT DOCUMENTS

JP 2006-031712 A 2/2006
KR 10-2006-0053928 A 5/2006

(Continued)

*Primary Examiner* — Anh V La
(74) *Attorney, Agent, or Firm* — Rabin & Berdo, P.C.

(57) ABSTRACT

The present invention relates to an anti-crime system using an RF dongle. More particularly, the present invention relates to an anti-crime system using an RF dongle, in which a detection sensor is mounted on a security window, a window or a door of a balcony, and the sensed signal acquired from the detection sensor is transmitted to a server by an Internet sharer using RF communication so as to inform the relevant persons in charge about the current state via the terminals of the relevant persons.

1 Claim, 2 Drawing Sheets

(51) Int. Cl.
*G08B 13/08* (2006.01)
*G08B 25/00* (2006.01)

(56) References Cited

U.S. PATENT DOCUMENTS

2011/0270952 A1 11/2011 Ray et al.
2013/0154823 A1* 6/2013 Ostrer ..... G08B 21/18 340/539.1

FOREIGN PATENT DOCUMENTS

KR 10-2007-0067302 A 6/2007
KR 10-2010-0003658 A 1/2010

* cited by examiner

ANTI-CRIME SYSTEM USING RF DONGLE

TECHNICAL FIELD

The present invention relates to an anti-crime system using an RF dongle. More particularly, the present invention relates to an anti-crime system using an RF dongle, in which a detection sensor is mounted on a security window, a window or a door of a balcony, and the sensed signal acquired from the detection sensor is transmitted to a server by an Internet sharer using RF communication so as to inform the relevant persons in charge about the current state via the terminals of the relevant persons.

BACKGROUND ART

In case of buildings such as an apartment or a row house, there is a very high risk of an external intrusion and theft through a balcony. Thus, even the hot summer, the residents cannot open the windows open at will.

In consideration of the above problem, the several types of anti-crime windows have been developed and become commercially available.

Generally, the anti-crime window includes a built-in fixing type window of completely blocking the inside and outside thereof and a moving type capable of selectively opening in case of emergency such as a fire or according to the need of the resident.

The fixing or moving type anti-crime window is assembled to and installed on the chassis of the balcony or the window frame and has a structure with high rigidity so as to keep out the external invader.

That is, the conventional anti-crime window includes a window fame of approximately rectangular shape as a basic structure and window bars that is, guard bars formed in vertical or horizontal direction on the inner side of the window. These components are made of a metal such as an aluminum or a steel in consideration of the structural stability thereof.

However, since a device or structure for monitoring the current status is not existed, it cannot quickly handle the trespassing.

DISCLOSURE

Technical Problem

Accordingly, the present invention has been made to solve the above-mentioned problems occurring in the prior art, and a object of the present invention is to provide an anti-crime system using an RF dongle in that, after a detection sensor is installed on an anti-crime window, a window or a door and a RF dongle is installed on any one of a knob, a security window, a window or a door frame, the RF dongle is connected to an Internet sharer and the received detection signal is transmitted to a server installed a remote place, thereby monitoring the current situation by means of the person in charge.

Technical Solution

In order to accomplish these objects, there is provided an anti-crime system using a RF dongle according to an embodiment of the present invention includes:

a detection sensor 200;

an RF transmitter 100 for obtaining a detection signal from the detection sensor 200 and transmitting the detection signal to an RF dongle 300 installed on any one of a knob, a security window, a window and a door frame;

the RF dongle 300 for receiving the detection signal transmitted from the RF transmitter 100 and transmitting a corresponding detection signal to a server 500 and having a port which can connect to an Internet sharer 400; and the server 500 for obtaining detection signal information so as to generate an event detection signal and transmitting the generated event detection signal to a security company terminal 600 and a mobile terminal 650.

Advantageous Effects

According to the anti-crime system using the RF dongle, after the detection sensor is installed on the anti-crime window, the window or the door and the RF dongle is installed on any one of the knob, the security window, the window or the door frame, the RF dongle is connected to the Internet sharer and the received detection signal is transmitted to the server installed the remote place, thereby monitoring the current situation by means of the person in charge.

BRIEF DESCRIPTION OF THE DRAWINGS

The above and other objects, features and advantages of the present invention will be more apparent from the following detailed description taken in conjunction with the accompanying drawings, in which.

DESCRIPTIONS ON REFERENCE NUMBERS FOR THE MAJOR COMPONENTS IN THE DRAWINGS

Figure 1:
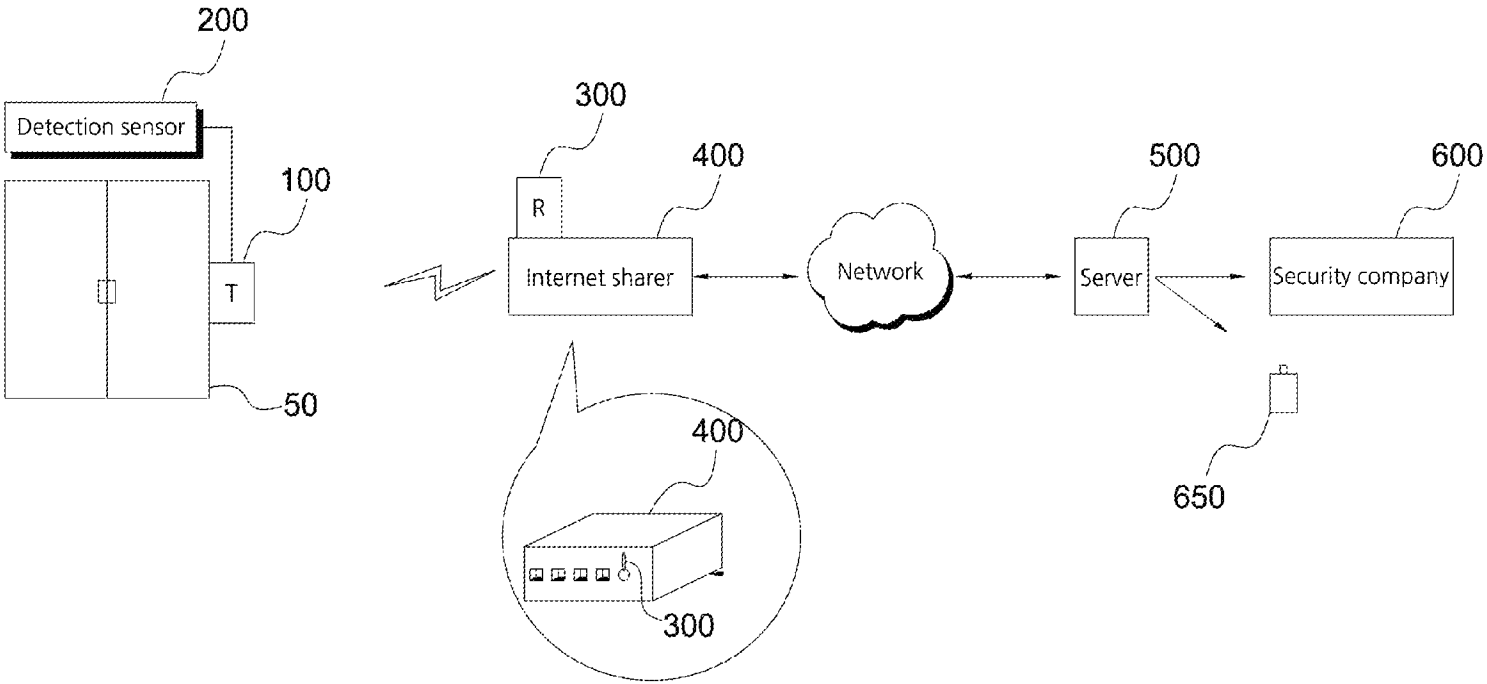
FIG. 1 is an overall configuration diagram of an anti-crime system using an RF dongle according to an embodiment of the present invention.

100: RF transmitter
200: Detection sensor
300: RF dongle
400: Internet sharer
500: Server
600: Security company terminal
650: mobile terminal

BEST MODE

Mode for Invention

The anti-crime system using the RF dongle according to an embodiment of the present invention for achieving the above object includes:

a detection sensor 200;

an RF transmitter 100 for obtaining a detection signal from the detection sensor 200 and transmitting the detection signal to an RF dongle 300 installed on any one of a knob, a security window, a window and a door frame;

the RF dongle 300 for receiving the detection signal transmitted from the RF transmitter 100 and transmitting a corresponding detection signal to a server 500 and having a port which can connect to an Internet sharer 400; and the server 500 for obtaining detection signal information so as to generate an event detection signal and transmitting the generated event detection signal to a security company terminal 600 and a mobile terminal 650.

In this case, the server 500 includes:

a detection signal acquiring unit 510 for acquiring the detection signal information;

an event receiving information storage unit 520 for storing information of the security company terminal 600 and the mobile terminal 650 of receiving the event detection signal therein;

a unique ID information storage unit 530 for storing a unique ID number of a building having the detection sensor, a unique ID number by installation location, and a detection threshold information therein;

an event generation determination unit 540 for comparing the detection threshold information with the received detection signal so as to determine as to whether the event is generated or not;

an event signal generation unit 550 for generating the event detection signal when it exceeds the threshold information in the event generation determination unit 540; and an event signal transmission unit 560 for transmitting the event detection signal to the security company terminal 600 and the mobile terminal 650 stored by the event receiving information storage unit 520 through a message.

At this time, it is characterized in that the RF dongle 300 measures a signal strength therein and does not operate when the threshold value or less.

At this time, it is characterized in that the RF dongle includes a packet processing unit for loading the detection signal to a data packet.

Also, the anti-crime system using the RF dongle according to an additional aspect of the present invention further includes a horizontal detection sensor for detecting a breakaway signal during the breakaway of any one of the anti-crime window of a balcony, the window and the door installed on the anti-crime window of a balcony, the window or the door.

Hereinafter, an exemplary embodiment of the present invention will be described in detail with reference to the accompanying drawings.

FIG. 1 is an overall configuration diagram of an anti-crime system using an RF dongle according to an embodiment of the present invention.

As shown in FIG. 1, the anti-crime system using the RF dongle according to an embodiment of the present invention includes:

a detection sensor 200;

an RF transmitter 100 for obtaining a detection signal from the detection sensor 200 and transmitting the detection signal to an RF dongle 300 installed on any one of a knob, a security window, a window and a door frame;

the RF dongle 300 for receiving the detection signal transmitted from the RF transmitter 100 and transmitting a corresponding detection signal to a server 500 and having a port which can connect to an Internet sharer 400; and the server 500 for obtaining detection signal information so as to generate an event detection signal and transmitting the generated event detection signal to a security company terminal 600 and a mobile terminal 650.

The detection sensor 200, which is installed on the anti-crime window of a balcony, the window or the door, serves to detect the signal and the RF transmitter 100, which is installed on any one of a knob, a security window, a window and a door frame, serves to obtain the detection signal from the detection sensor 200 and transmit the detection signal to the RF dongle 300.

The detection sensor may be, for example, a vibration detection sensor, a separating detection sensor, an infrared detection sensor or the like. However, the present invention is not limited to a particular detection sensor.

At this time, the RF dongle 300, which is configured to install on an Internet sharer 400, serves to receive the detection signal transmitted from the RF transmitter 100 and transmit the corresponding detection signal to the server 500.

Also, the RF dongle 300 has the port which can be attached and deattached to the Internet sharer 400.

In other words, the RF dongle 300 can be connected to the Internet sharer 400 by means of a RS232 port, a RS485 port, an USB port, a LAN port etc.

Further, it is characterized in that the RF dongle 300 includes a packet processing unit for loading the detection signal to a data packet.

This allows the detection signal to be transmitted to a remote location through the data packet.

Also, it is characterized in that the RF dongle 300 measures a signal strength therein and does not operate in case of the threshold value or less.

That is, in case of a non-significant signal, if the data transfer is made, since it has an impact on the network, the small fine signal is ignored.

On the other hand, the anti-crime system using the RF dongle according to an additional aspect of the present invention further includes a horizontal detection sensor (not shown) installed on the anti-crime window of a balcony, the window or the door so as to detect a breakaway signal during the breakaway of any one of the anti-crime window of a balcony, the window and the door.

That is, in case of the breakaway of the anti-crime window of a balcony, the window or the door, the horizontal detection sensor detects the breakaway signal and transmits the corresponding detection signal to the RF transmitter 100.

Moreover, the server 500 serves to obtain the detection signal information so as to generate an event detection signal and transmit the event detection signal to the security company terminal 600 and the mobile terminal 650.

Figure 2:
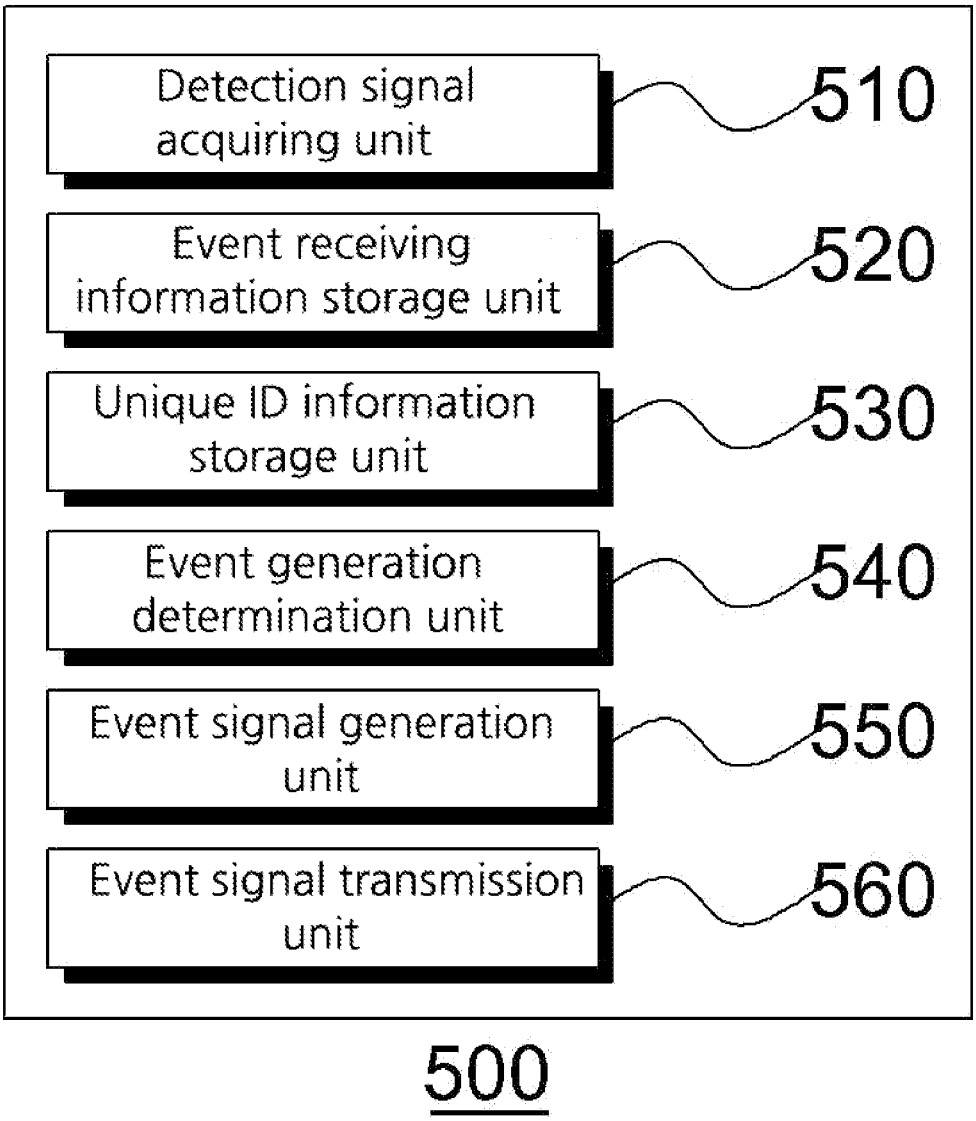
FIG. 2 is a block diagram illustrating of a sever of an anti-crime system using an RF dongle according to an embodiment of the present invention.

FIG. 2 is a block diagram illustrating of a sever of an anti-crime system using an RF dongle according to an embodiment of the present invention.

As shown in FIG. 2, the server 500 includes:

a detection signal acquiring unit 510 for acquiring the detection signal information;

an event receiving information storage unit 520 for storing information of the security company terminal 600 and the mobile terminal 650 of receiving the event detection signal therein;

a unique ID information storage unit 530 for storing a unique ID number of a building having the detection sensor, a unique ID number by installation location, and a detection threshold information therein;

an event generation determination unit 540 for comparing the detection threshold information with the received detection signal so as to determine as to whether the event is generated or not;

an event signal generation unit 550 for generating the event detection signal when it exceeds the threshold information in the event generation determination unit 540; and an event signal transmission unit 560 for transmitting the event detection signal to the security company terminal 600 and the mobile terminal 650 stored by the event receiving information storage unit 520 through a message.

The detection signal acquiring unit 510 serves to acquire the detection signal information transmitted from the RF dongle installed in the Internet sharer 400.

The event receiving information storage unit 520 serves to store the information of the security company terminal 600 and the mobile terminal 650 of receiving the event detection signal therein.

That is, the information such as the unique number of the security company terminal 600 and the mobile terminal 650 for receiving the corresponding generation information during the generation of the event is stored therein.

The unique ID information storage unit 530 serves to store the unique ID number of the building, in which the detection sensor is installed and configured, the unique ID number by installation location, and the detection threshold information therein.

In other words, the unique ID numbers of the building are given to each building and the unique ID numbers by installation location are given to the bedroom window and the living room window having the detection sensors and so on, so that the given numbers are stored therein.

The detection threshold information means the reference point for generating the event when it exceeds the predetermined threshold value.

The event generation determination unit 540 serves to compare the detection threshold information with the received detection signal so as to determine as to whether the event is generated or not. For example, if the detection sensor is a vibration sensor, when the vibration value of the vibration detection signal is 50 and the threshold value is 100, it is judged as a vibration due to normal wind conditions. On the contrary, the vibration value of the vibration detection signal is 150, it is judged as the generation of the event.

The event signal generation unit 550 serves to generate the event detection signal when it exceeds the threshold information in the event generation determination unit 540.

In other words, the generated unique ID number of the corresponding building, the generated unique ID number of the corresponding installation location, and the detection value and so on are acquired to be added to the event detection signal.

The event signal transmission unit 560 serves to transmit the event detection signal to the security company terminal 600 and the mobile terminal 650 stored by the event receiving information storage unit 520 through the message.

In other words, the event signal transmission unit 560 transmits the event detection signal to the mobile phone No. 010-123-4567 as the event message.

According to the configuration and the operation as described above, after the detection sensor is installed on the anti-crime window, the window or the door and the RF dongle is installed on any one of the knob, the security window, the window or the door frame, the RF dongle is connected to the Internet sharer and the received detection signal is transmitted to the server installed the remote place, thereby monitoring the current situation by means of the person in charge.

Although a preferred embodiment of the present invention has been described for illustrative purposes, those skilled in the art will appreciate that various modifications, additions and substitutions are possible, without departing from the scope and spirit of the invention as disclosed in the accompanying claims.

INDUSTRIAL APPLICABILITY

According to the present invention, after the detection sensor is installed on the anti-crime window, the window or the door and the RF dongle is installed on any one of the knob, the security window, the window or the door frame, the RF dongle is connected to the Internet sharer and the received detection signal is transmitted to the server installed the remote place, thereby monitoring the current situation by means of the person in charge. Accordingly, it may be widely utilized in the field of crime prevention.

What is claimed is:

1. An anti-crime system using a RF dongle comprising:

a detection sensor 200;

an RF transmitter 100 for obtaining a detection signal from the detection sensor 200 and transmitting the detection signal to an RF dongle 300 installed on any one of a knob, a security window, a window and a door frame;

the RF dongle 300 for receiving the detection signal transmitted from the RF transmitter 100 and transmitting a corresponding detection signal to a server 500 and having a port which can connect to an Internet sharer 400; and the server 500 for obtaining detection signal information so as to generate an event detection signal and transmitting the generated event detection signal to a security company terminal 600 and a mobile terminal 650, wherein the server 500 comprises:

a detection signal acquiring unit 510 for acquiring the detection signal information;

an event receiving information storage unit 520 for storing information of the security company terminal 600 and the mobile terminal 650 of receiving the event detection signal therein;

a unique ID information storage unit 530 for storing a unique ID number of a building having the detection sensor, a unique ID number by installation location, and a detection threshold information therein;

an event generation determination unit 540 for comparing the detection threshold information with the received detection signal so as to determine as to whether the event is generated or not;

an event signal generation unit 550 for generating the event detection signal when it exceeds the threshold information in the event generation determination unit 540; and an event signal transmission unit 560 for transmitting the event detection signal to the security company terminal 600 and the mobile terminal 650 stored by the event receiving information storage unit 520 through a message.

* * * * *